US005862721A

United States Patent [19]

Kowats

[11] Patent Number: 5,862,721

[45] Date of Patent: Jan. 26, 1999

[54] FAUCET HANDLE TOOL

[76] Inventor: Henry A. Kowats, 1544 Talcott Rd., Park Ridge, Ill. 60068

[21] Appl. No.: 489,453

[22] Filed: Jun. 12, 1995

[51] Int. Cl.[6] ..... B25B 13/06

[52] U.S. Cl. ..... 81/121.1; 81/3.4

[58] Field of Search ..... 81/121.1, 120, 81/124.3, 124.7, 3.4

[56] References Cited

U.S. PATENT DOCUMENTS

| | | | |
|---|---|---|---|
| 1,321,776 | 11/1919 | Stepanian . | |
| 1,954,422 | 4/1934 | McIntyre | 81/120 X |
| 2,599,668 | 6/1952 | Taylor | 81/90 |
| 3,010,346 | 11/1961 | Kulp | 81/90 |
| 3,779,104 | 12/1973 | Curry | 81/119 |
| 4,459,716 | 7/1984 | Valadez | 81/121.1 X |
| 4,562,758 | 1/1986 | Stirling | 81/124.4 |
| 4,766,781 | 8/1988 | Grisé et al. | 81/3.4 |
| 4,817,475 | 4/1989 | Kelly et al. | 81/121.1 |

*Primary Examiner*—D. S. Meislin
*Attorney, Agent, or Firm*—Knechtel, Demeur & Samlan

[57] ABSTRACT

A faucet handle turning tool having a cylindrically-shaped body member with a cavity in one end. The cavity has sidewalls which taper inwardly to engage a faucet handle. There is a hexagonal head on one end of the cylindrical body to receive a wrench which provides the turning movement to turn the body member. A square bore is disposed within the hexagonal head to receive a ratchet drive which can provide the rotating driving movement to the hexagonal head. By utilizing separately provided ratchet or wrench drive means, the faucet handle tool requires only a minimum amount of storage space within a tool box.

1 Claim, 1 Drawing Sheet

FAUCET HANDLE TOOL

BACKGROUND AND SUMMARY OF THE INVENTION

This invention relates to faucet handle tools and, particularly, to a low profile faucet handle turning tool which is adapted to be fitted over a faucet handle to provide added turning leverage.

Valve and faucet handles used in plumbing often become rusted, limed and corroded making them difficult to turn. This is especially true in the case of elderly persons, persons suffering physical problems which make it difficult to exert a great deal of force on the handle in order to break it free and even in the case of persons having no physical problems if the valve and faucet handle have become severely corroded, limed or rusted. At times, the valve or faucet handle is positioned in such a location that it is difficult to reach by hand or to apply a wrench or other tool to the faucet handle due to a minimum amount of clearance. Modern faucet handles are frequently made of plastic or light metal or plastic-type materials. Wrenches, pliers and the like when applied to these plastic or light metal handles will frequently crack or break them. Thus, there is a need for a mechanism to assist in loosening plastic faucet handles which can fit in minimum clearance areas and is simple to use.

An example of a valve and faucet handle tool is illustrated in U.S. Pat. No. 4,562,758. This patent discloses a faucet handle turning tool which has a cavity at one end and a handle protruding from the other end. The cavity is designed to be placed over the faucet handle. The handle of the tool is then rotated to provide leverage and thus assists in turning the faucet. A disadvantage of this tool is that its handle is part of the overall tool. The result is that this tool takes up more room in the toolbox or storage area than if the tool did not have an integral protruding handle. Furthermore, the fixed length of the handle determines the maximum amount of leverage which can be applied to the tool.

Another device is illustrated in U.S. Pat. No. 3,010,346. This patent illustrates a petcock drain tool which has a shaft which pivots about a pivot point. Thus, the flexibility of the shaft permits the tool to access places which a straight shaft tool could not reach. Again, however, as the shaft is part of the tool, it takes up valuable storage space in a toolbox.

Another device is illustrated in U.S. Pat. No. 2,599,668 which is a radiator cap wrench which assists in removing a radiator cap while the operator's hand is kept away from the top of the radiator cap. The handle is integral with the wrench and, for the same reasons cited above, would take up valuable storage space in a toolbox.

Ideally, a tool should take up a minimum amount of space in storage, function for the purpose intended, be inexpensive to manufacture and sell and efficiently serve the purpose for which it is intended. Applicant's device is such a tool. As most persons undertaking any repair job have at a minimum either a set of open-ended wrenches, a ratchet wrench or an adjustable wrench, the repair person already has a means by which he or she can provide a lever arm to an adapter tool. Thus, there is no need to duplicate this function which can easily be provided by tools already existing in the toolbox. Applicant's device is an adapter which fits over the faucet handle and receives the faucet handle internally in a cavity. The side of the tool opposite the cavity is adapted for receiving either a ratchet drive or a wrench. With the tool placed over the faucet handle, the wrench or ratchet engages the turning mechanism and the tool is turned which in turn turns the faucet handle. Due to the design of Applicant's device, a very low profile faucet handle turning tool is achieved which allows the repairman to work in extremely close areas.

OBJECTS AND ADVANTAGES

Thus, it is an object of this invention to provide a faucet handle turning tool which assists in turning plastic or light metal faucet handles without cracking or breaking them.

It is another object of this invention to provide a faucet handle turning tool which is very low profile thereby allowing the repairman to work in extremely close spaces.

Still another object is the object of providing a faucet handle turning tool which is adapted to be rotated by wrenches or ratchet-drive mechanisms already found in the repairman's normally stocked tools.

Yet, another object is the object of providing a faucet handle turning tool which will receive faucet handles of varying dimensions and will engage the same without the need of any modifications or adapters. Another object is the object of providing a faucet handle turning tool which is inexpensive to manufacture and simple in design.

These and other objects and advantages will be apparent upon reviewing the following description of the drawings and detailed description of the preferred embodiment.

DESCRIPTION OF THE PREFERRED EMBODIMENT

Figure 1:
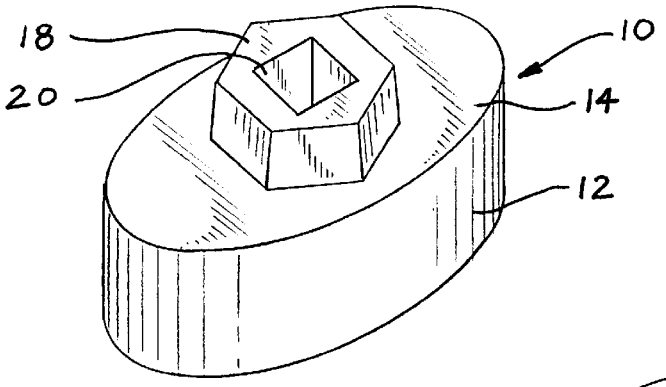
FIG. 1 is a perspective view of the low profile faucet handle turning tool.
Figure 2:
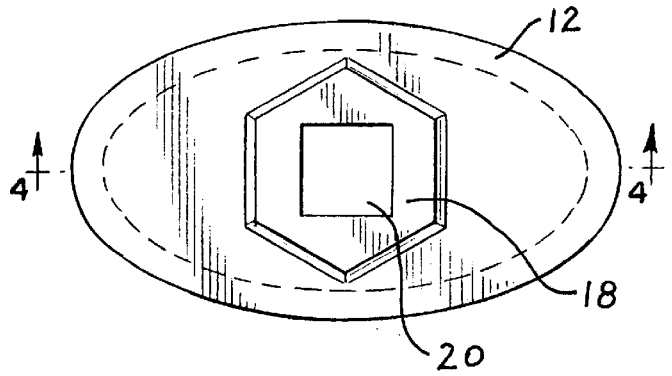
FIG. 2 is a top plan view of the tool of FIG. 1.

Turning first to FIG. 1 there is illustrated a low profile faucet handle turning tool 10 of the present invention. The tool 10 has a generally cylindrical body 12. Preferentially, the body 12 is elliptical in design as most modern plastic faucet handles are generally elliptical in shape. The body 12 has a substantially flat top 14 and an open end 16 opposite the top 14. There is a hexagonal head 18 which is integral with the top 14. The hexagonal head is centrally placed on the top 14. The dimensions of the hexagonal head 18 should be such that the sides opposite each other are of a standard open end wrench size. (For example, ¾".) Centrally disposed within the hexagonal head 18 is a square bore 20 which extends through the hexagonal head 18 and the cylindrical body 12. The square bore 20 should be a standard size such as ⅝ inch to receive a standard ratchet drive.

Figure 3:
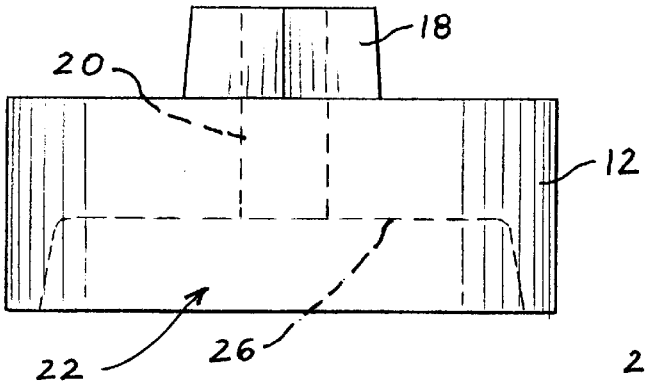
FIG. 3 is a side elevational view of the tool of FIG. 1.
Figure 4:
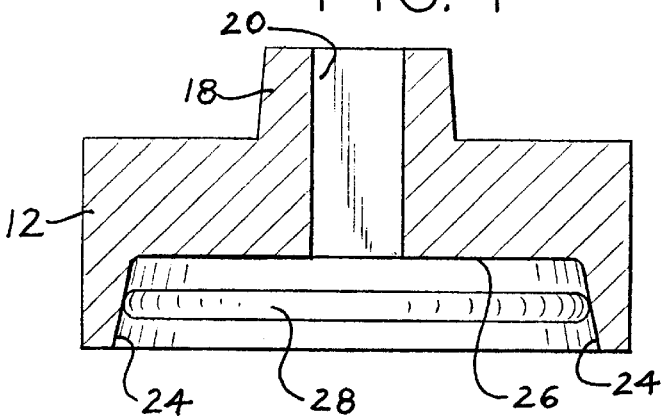
FIG. 4 is a cross sectional view taken along line 4—4 of FIG. 2.

As seen in FIG. 3, there is a cavity 22 within the cylindrical body 12. The cavity 22 starts at the open end 16 and ends at a bottom 26. As seen in FIG. 4 which is a cross sectional view of the body 12, the dimensions of cavity 22 are defined by tapered sidewalls 24 which extend from the open end 16 to the bottom 26. The tapering of the sidewalls 24 enables various dimensioned faucet handles to be received therein. In FIG. 4, a handle 28 is received within the cavity 22 and engages the tapered sidewalls 24 approximately half way up from the open end 16. If the faucet handle 28 was smaller, it would be received further into the cavity 22 and closer to the bottom 26.

Once the faucet handle 28 frictionally engages the tapered sidewalls 24, the repairman merely places a ratchet drive into the square bore 20 and turns the cylindrical body by means of rotating the ratchet drive. By adding additional lengths to the ratchet drive, the leverage can easily be increased.

On the other hand, if the user does not have a ratchet drive, but only has an open end or adjustable wrench, the same can be used by engaging the hex head 18. Again, leverage is applied to the wrench which rotates the cylindrical body 12 thereby turning the faucet handle 28.

Applicant's invention results in a low profile tool. Essentially, the overall height is the height from the open end 16 to the top of the hexagonal head 18. Previously, no such tool permitted working in such close space while permitting various extensions of the handle to achieve maximum leverage.

The cylindrical body can be manufactured out of metal or plastic. Its design is such that it can be manufactured in a single integral mold. It can be manufactured very inexpensively, as the user is not paying for additional material to form the handles, as Applicant's device is adapted for use with the user's ratchet drive or wrenches. Thus, a minimum amount of space is taken up in the repairman's toolbox or tool shelf resulting in not only economies of storage space but weight also.

Accordingly, there is disclosed a faucet tool handle that fully satisfies the objects, aims and advantages set forth above. While it has been disclosed in one specific embodiment, other variations thereof will be apparent to those skilled in the art. Accordingly, it is intended to embrace all such alternatives, modifications and variations as fall within the spirit and scope of the appended claims.

What is claimed is:

1. A low profile faucet handle turning tool comprising:

a cylindrical shaped body member having an elliptically shaped cavity extending axially in one end thereof, the cavity having sidewalls which taper inwardly from the open end of the cavity toward the center of the cavity, the tapering sidewalls adapted to engage faucet handles of different dimensions, the cylindrical body having a height defined by the distance from the open end to a top surface opposite the open end;

a hexagonal head affixed to the top surface of the cylindrical shaped body member on the end opposite the cavity, the hexagonal head extending substantially perpendicular to the cylindrical shaped body member, the head having a height defined by the distance from the cylindrical body to a top end, the overall height of the low profile tool being defined by the combined height of the height of the head and the height of the cylindrical body, the hexagonal head adapted to be received by a wrench such that the wrench provides the force to turn the hexagonal head and body;

a square bore axially and centrally disposed within the hexagonal head, the square bore adapted to receive a drive ratchet such that the drive ratchet provides the force to turn the hexagonal head and body, whereby the cavity on the one end of the faucet handle turning tool is placed over the faucet handle and the head is rotated by means of the drive ratchet or wrench engaging the hexagonal head in rotating driving movement.

* * * * *